US012497843B2

(12) United States Patent
Steele et al.

(10) Patent No.: US 12,497,843 B2
(45) Date of Patent: Dec. 16, 2025

(54) EXTENSIBLE TRANSITION JOINT FOR CONTROL LINE PROTECTION

(71) Applicant: Halliburton Energy Services, Inc., Houston, TX (US)

(72) Inventors: David Joe Steele, Carrollton, TX (US); Justin Mark Roberts, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/662,512

(22) Filed: May 13, 2024

(65) Prior Publication Data

US 2024/0295150 A1 Sep. 5, 2024

Related U.S. Application Data

(62) Division of application No. 17/585,260, filed on Jan. 26, 2022, now Pat. No. 12,006,775.

(60) Provisional application No. 63/178,652, filed on Apr. 23, 2021.

(51) Int. Cl.
*E21B 17/00* (2006.01)
*E21B 47/12* (2012.01)

(52) U.S. Cl.
CPC ..... *E21B 17/003* (2013.01); *E21B 47/12* (2013.01)

(58) Field of Classification Search
CPC ..... E21B 17/07; E21B 23/004; E21B 47/12; E21B 47/138; E21B 17/023
See application file for complete search history.

(56) References Cited

U.S. PATENT DOCUMENTS 3,885,625 A * 5/1975 Ahlstone ..... E21B 33/043 166/208
4,765,403 A * 8/1988 Crawford ..... E21B 43/123 166/117.6
5,477,923 A 12/1995 Jordan, Jr. et al.
RE37,867 E 10/2002 Gondouin
(Continued)

FOREIGN PATENT DOCUMENTS

CN 110905477 3/2020
EP 2221446 8/2010
(Continued)

OTHER PUBLICATIONS

RapidX TAML 5 High-Strength, Hydraulic-Sealed Multilateral Junction, Accessed Jan. 20, 2022.
RapidXtreme RapidX , Accessed Jan. 20, 2022.
RapidXtreme TAML 3, 4, or 5 Large-Bord Multilateral Junction RapidXtreme, Accessed Jan. 20, 2022.
RapidXtreme TAML 3, 4, or 5 large-bore multilateral junction is a robust, modular system. It is currently the only multilateral system in the industry that is rated at 10,000 psi differential pressure at the junction, Accessed Jan. 20, 2022.
(Continued)

*Primary Examiner* — Shane Bomar
(74) *Attorney, Agent, or Firm* — Scott Richardson; C. Tumey Law Group PLLC

(57) ABSTRACT

Systems and methods of the present disclosure relate to protecting a control line as it passes through a junction in a downhole environment. An ETJ deployment tool (ETJDT) comprises a tool body comprising a central bore; at least one first component and at least one second component, each component operable to extend and retract laterally from the tool body, wherein the at least one second component is disposed at an axial distance from the at least one first component along the tool body; a member disposed within the central bore and operable to move forward upon receiving fluid; and a spring disposed axially between a portion of the member and the at least one second component.

20 Claims, 19 Drawing Sheets

(56) References Cited

U.S. PATENT DOCUMENTS

| | | | | |
|---|---|---|---|---|
| 6,527,067 | B1 * | 3/2003 | Ravensbergen | E21B 41/0035 175/73 |
| 7,373,984 | B2 | 5/2008 | Pratt et al. | |
| 2010/0059279 | A1 * | 3/2010 | Saylor | E21B 23/12 175/45 |
| 2010/0319928 | A1 | 12/2010 | Bussear et al. | |
| 2015/0047853 | A1 | 2/2015 | Hurtado | |
| 2015/0096747 | A1 | 4/2015 | Brown-Kerr et al. | |
| 2016/0145956 | A1 * | 5/2016 | Dahl | E21B 23/12 166/117.6 |
| 2018/0274300 | A1 | 9/2018 | Vemuri et al. | |
| 2019/0120021 | A1 * | 4/2019 | Steele | E21B 23/12 |
| 2019/0153841 | A1 | 5/2019 | Randall et al. | |
| 2019/0186222 | A1 * | 6/2019 | Steele | E21B 41/0035 |
| 2020/0149363 | A1 | 5/2020 | Cho et al. | |
| 2020/0256128 | A1 | 8/2020 | Cho et al. | |
| 2021/0140276 | A1 | 5/2021 | Steele, Jr. | |
| 2021/0230978 | A1 | 7/2021 | Steele et al. | |
| 2022/0333462 | A1 | 10/2022 | Rosas Fermin et al. | |

FOREIGN PATENT DOCUMENTS

| | | |
|---|---|---|
| EP | 2354437 | 8/2011 |
| WO | 2014-109962 | 7/2014 |

OTHER PUBLICATIONS

Manara System in Multilateral Wells, Control flow from each zone in each lateral, separately, Schlumberger, Accessed Jan. 20, 2022.

International Search Report and Written Opinion for Application No. PCT/US2022/015197, dated May 24, 2022.

Office Action Summary for U.S. Appl. No. 17/585,260 dated Nov. 7, 2023.

Notice of Allowance for U.S. Appl. No. 17/585,260 dated Feb. 14, 2024.

* cited by examiner

EXTENSIBLE TRANSITION JOINT FOR CONTROL LINE PROTECTION

CROSS-REFERENCE TO RELATED APPLICATIONS

The present application is a divisional of U.S. patent application Ser. No. 17/585,260, filed Jan. 26, 2022, which is a non-provisional of U.S. Provisional Patent Application No. 63/178,652, filed Apr. 23, 2021, the entire disclosures of which are incorporated herein by reference.

BACKGROUND

In order to provide communications, control, and monitoring in lateral wellbores, control lines may need to be positioned in the lateral wellbores. When running the control lines through a junction (e.g., a casing window), the control lines may be inclined to rub against the junction. For example, sides of the junction (e.g., a milled edge of the casing window) may cut or abrade the control lines. In addition, the need to pick up on a completion string with the control lines fastened may cause the control lines to rub against a top edge of the junction causing the control lines to be pinched, crushed, cut, or otherwise damaged.

BRIEF DESCRIPTION OF THE DRAWINGS

These drawings illustrate certain aspects of some examples of the present disclosure and should not be used to limit or define the disclosure.

DETAILED DESCRIPTION

Figure 1A:
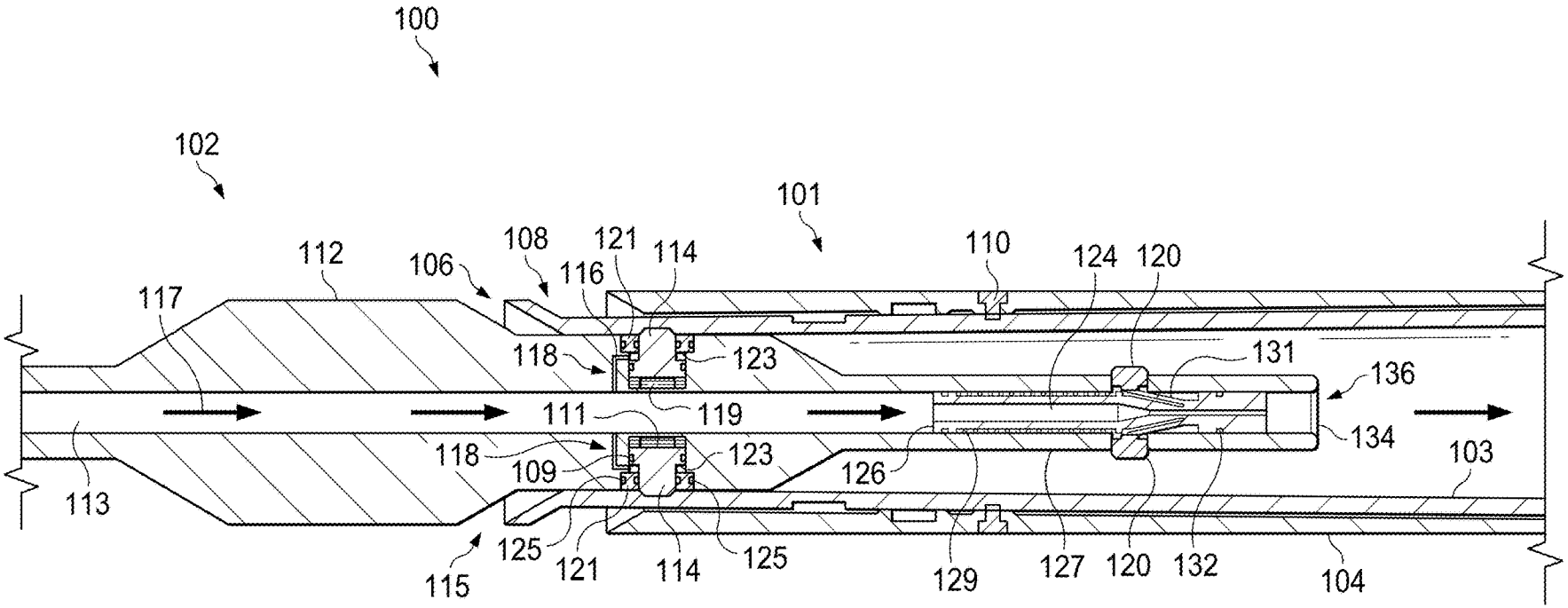
FIG. 1A illustrates an extensible transition joint deployment system (ETJDS), in accordance with examples of the present disclosure.

The present disclosure generally relates to techniques for deploying an extensible transition joint (ETJ) in a secondary wellbore such as for example, a lateral wellbore. The ETJ may include an extendable tubular operable to protect a control line passing through a junction in a downhole environment.

In some examples, a control line may include a piece of ¼ inch steel tubing, an encapsulated steel tubing, an armored/protected tube. The control line may also be used for more than control purposes, in some examples. For examples, techniques of the present disclosure may also protect any device that may pass through a wellbore junction (e.g., a milled window in casing). This protection may also work in uncased wells, where control lines, may be damaged by going through a side-traced wellbore (e.g., geothermal work).

In some examples, the junction may include a milled casing exit/window, pre-milled casing exit, earthen junctions, and/or twigs. The ETJ may include a first member movably disposed within a second member. In some examples, the first and second members may include tubulars. The first member may include an outer diameter (OD) that is less than an ID of the second member and may be operable to extend from a retracted position within the second member (e.g., telescopic members). In some examples, the first member may be concentrically disposed within the second member.

In particular examples, the ETJ may be run into the secondary wellbore with an ETJ deployment tool (ETJDT). The ETJDT may utilize fluid pressure to engage and disengage the ETJ and/or a liner or other tubular/tool. The ETJ may be run above (up-hole to the liner) or near a top of a liner in a locked/collapsed/retracted configuration. The ETJDT may be released from the ETJ and/or the liner and pulled back into a primary wellbore from the secondary wellbore. The ETJDT may then be lowered into the primary wellbore to engage and retrieve a whipstock from the primary wellbore.

Then, a completion deflector (CD) may be run into the primary wellbore with a CD running tool (CDRT). The CDRT may be operable to position the CD in the primary wellbore, release from the CD, and be guided into the secondary wellbore to engage the ETJ. In some examples, the CDRT may be operable to wash the ETJ and wellbore of debris. The CDRT may release the first member from within the second member (i.e., the ETJ is in a retracted/collapsed configuration) and extend the first member of the ETJ from the second member via, for example, fluid pressure and/or pull strength. The CDRT may pull the first member of the ETJ in an up-hole direction into the primary wellbore from the secondary wellbore.

Once the ETJ is pulled a desired amount, a no-go or other stop feature may stop the first member from completely separating or moving too far out from the second member. Once the ETJ is at the desired extended position, the CDRT is released and pulled out of the wellbore. Then, a completion string (e.g., 3.5 inch) with control line(s) is disposed in the primary wellbore. At an upper end of the completion string, a device may be installed that may collapse the ETJ (e.g., move first member back into second member) such that both members are positioned in the secondary wellbore to provide full-bore access again to the primary wellbore. A junction then may be disposed on a upper end of the completion string.

Some examples may include an ETJ that may include a scoop-head. The scoop-head or gentle guide at the top of the ETJ to urge control lines and related equipment to enter the ETJ without causing damage. The ETJ may include at least one solid or fluted component made of a material such as brass, steel, elastomer, or combinations thereof. The ETJ may include one tubular fully or partially engaged within the other. In some examples, a shoulder may be operable to transmit loads from one component to another component, and/or to one or more exterior components/devices. A releasable lock may secure two or more components (e.g., tubulars) together until a pre-determined force/load/pressure/flow/signal is generated indicating the locking device should release. Likewise, a releasable lock may secure two or more components (e.g., tubulars) together in the extended position, RIH position, and the collapse position (e.g. first member moved back into second member) until a predetermined force/load/pressure/flow/signal is generated indicating the locking device should release. In some examples, flow ports may direct fluid flow in a particular direction to flush debris from undesirable areas.

The ETJ includes a large ID and relatively small OD so as pass into a secondary wellbore without issues. An extension lock may hold the ETJ in an extended position. A complimenting extension lock release mechanism may release the ETJ from the extended position. A temporary guide may shift the ETJ from an extended position to a collapse position when the ETJ is unlocked. A collapse-position lock may hold the ETJ in an un-extended position/collapsed position. A temporary guide (e.g., a tubular) may activate the collapse-position lock.

FIG. 1A illustrates an ETJ deployment system (ETJDS) 100 in accordance with examples of the present disclosure. The ETJDS 100 may include an ETJ 101 disposed on an ETJDT 102.

The ETJ 101 may include a first member 103 movably disposed within a second member 104. In some examples, the first member 103 and the second member 104 may each include a tubular. The first member 103 may include an outer diameter (OD) that is less than an ID of the second member 104 and may be operable to extend from within the second member 104 in an axial up-hole direction. In some examples, the first member 103 may be concentrically disposed within the second member 104. In some examples, the ETJ 101 may be sealed. In some examples, the ETJ 101 may have wiper seals to prevent debris from entering between the two members.

A proximal end 106 of the first member 103 may include a tapered profile 108. The tapered profile 108 may extend in an axial direction. In some examples, the tapered profile 108 may be concave or include a scoop. The tapered profile 108 may include more than one material. For example, an aluminum bronze insert may line the guide to prevent a softer control line from wearing due to contact with a harder surface/material (e.g., steel) typically used in making oilfield tubulars). The tapered profile 108 may be operable to gradually guide the control lines and related equipment into the ETJ without causing damage to the control lines and the related equipment. The proximal end 106 may also be utilized to retract (e.g., guide) the first member 103 into the second member 104 upon unlocking of an extension lock 110 (e.g., shear screws).

The extension lock 110 may secure the first member 103 within the second member 104, in an extended position, and prevent retraction of the first member 103 into the second member 104. In other examples, the extension lock 110 may releasably secure the first member 103 within the second member 104, but release the first member 103 from the second member 104 when a suitable tool (or tool's profile) engages the extension lock 110. The extension lock 110 may allow the first member 103 into the second member 104 repeatedly locked in the extended and retracted positions. An extension lock release mechanism may unlock the first member 103 from the second member 104 to allow retraction of the first member 103 into the second member 104. In some examples, the proximal end 106 may be utilized to shift the first member 103 from an extended position to a retracted position, upon actuation of the extension lock release mechanism. In some examples, the first member 103 may be re-extended back up into the primary wellbore and the tubing string (with control lines) may be re-run back out into the secondary wellbore. In some examples, the first member 103 may be re-extended due to failure of equipment (e.g., inflow control equipment) during installation.

The ETJDT 102 may include a body 112 with a central bore 113 extending lengthwise through the body 112. The body 112 may be sized to fit within various sized tubulars.

At least one dog 114 (e.g., a fluid-actuated member) may be movably disposed in a first section 115 of the body 112 (e.g., up-hole section). Each dog 114 may be in fluid communication, via a channel 116, with the central bore 113 to allow fluid 117 passing therethrough to retract the dogs 114, for example, to disengage from the ETJ 101.

Each dog 114 may be disposed within a chamber 118 which may receive the fluid 117 to cause each dog 114 to retract within the respective chamber 118. Each dog 114 may include a seal 109 (e.g., O-ring). A reduced fluid pressure may cause the dogs 114 to extend, for example, to engage the ETJ 101. A spring 119 may be disposed in the chamber 118 between the dog 114 and a floor of each chamber 118. Each chamber 118 may include a vent hole 111 to release the fluid 117.

During extension, the spring 119 (e.g., Belleville spring) may compress the dog 114 outward against a retaining cap 121 when fluid pressure is below a threshold, causing each of the dogs 114 to protrude outward, for example, to engage the ETJ 101. Each dog 114 may receive the fluid 117 to cause each dog 114 to retract within the respective chamber 118 and compress each spring 119. Each dog 114 may include a shoulder 123 to contact the retaining cap 121. Seal(s) 125 (e.g., O-rings) may be disposed around each of the retaining caps 121.

At least one smaller dog 120 may be disposed in a chamber 124 on a second section 127 of the body 112 which may be downhole from the first section 115. A member 126 may be movably disposed within the central bore 113 of the ETJDT 102. As the fluid 117 moves into the second section 127, the fluid 117 may force movable member 126 to move axially downhole within the central bore 113 of the ETJDT 102 to compress a spring 129 disposed axially between the dog 120 and the member 126. The member 126 may include a distal end with ramps 131 tapering inward in a downhole direction to gradually extend or retract the dog 120 into each chamber 124.

When each spring 119 is not compressed (an extended state), a fluid pressure threshold is not satisfied, and a downhole portion (smaller height) of each ramp 131 contacts the dog 120 causing retraction of each dog 120 into its respective chamber 124. When the fluid pressure satisfies the threshold, an up-hole portion (larger height) of each ramp 131 contacts and drives outward the dogs 120. The dogs 120 may be operable to engage and disengage from a whipstock. A distal end 134 of the member 126 may include a nozzle 136 to allow egress of the fluid 117 from the ETJ 101. A seal 132 (e.g., O-ring) may be disposed between the distal end 134 and the second section 127 of the tool body 112.

Figure 1B:
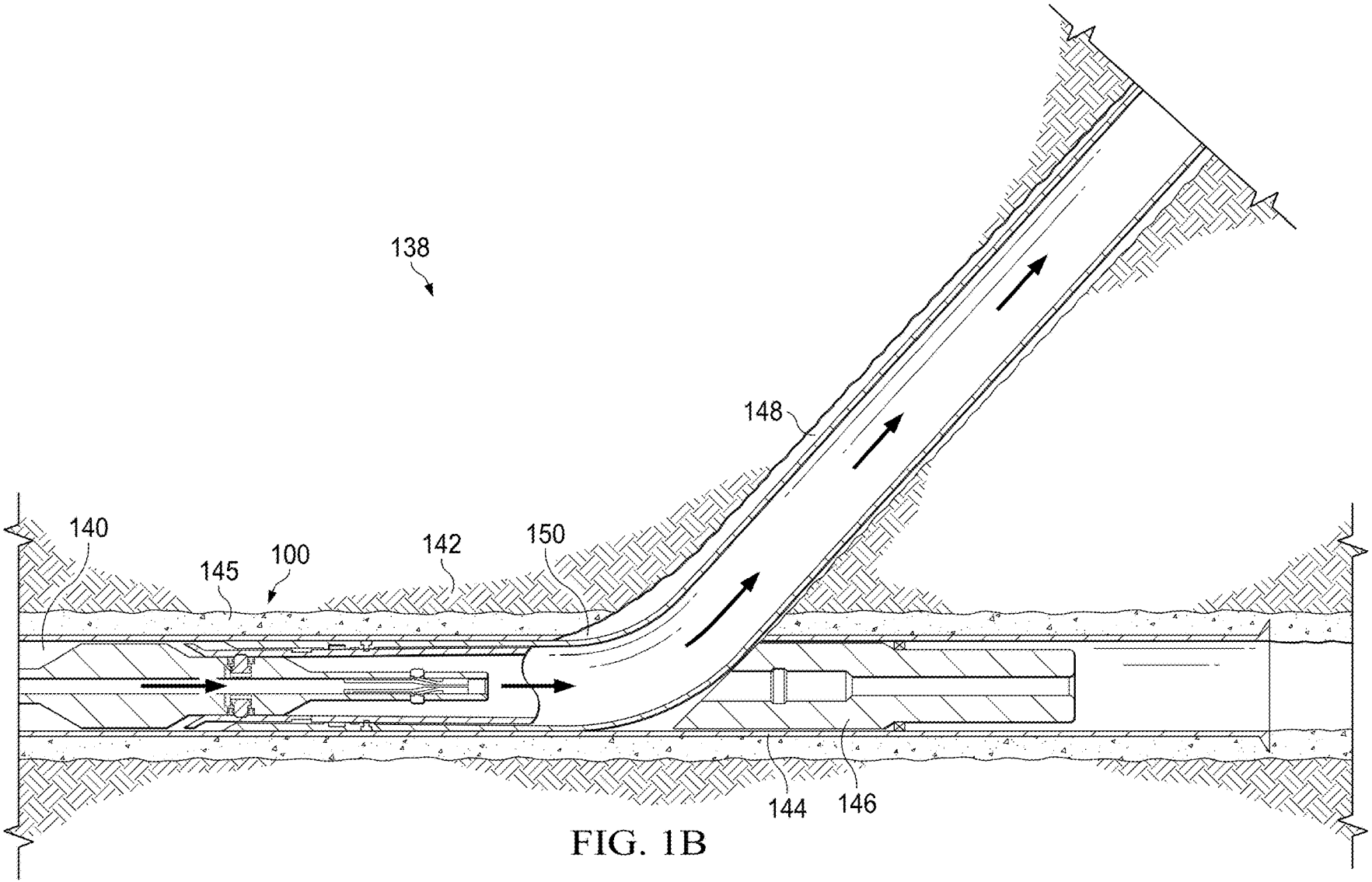
FIG. 1B illustrates running the ETJDS into a well system, in accordance with examples of the present disclosure.

FIG. 1B illustrates a well system 138 in accordance with examples of the present disclosure. A primary wellbore 140 extends through a subterranean formation 142. A portion of the primary wellbore 140 may be lined with a casing string 144, which may be secured in place with cement 145. The primary wellbore 140 may include a whipstock 146. A secondary wellbore 148 may extend from the primary wellbore 140 via a casing window 150. The ETJDS 100 may be run into the primary wellbore 140. The casing window 150, in this example, may be a longitudinal hole created in a portion (joint) of casing 144.

Figure 1C:
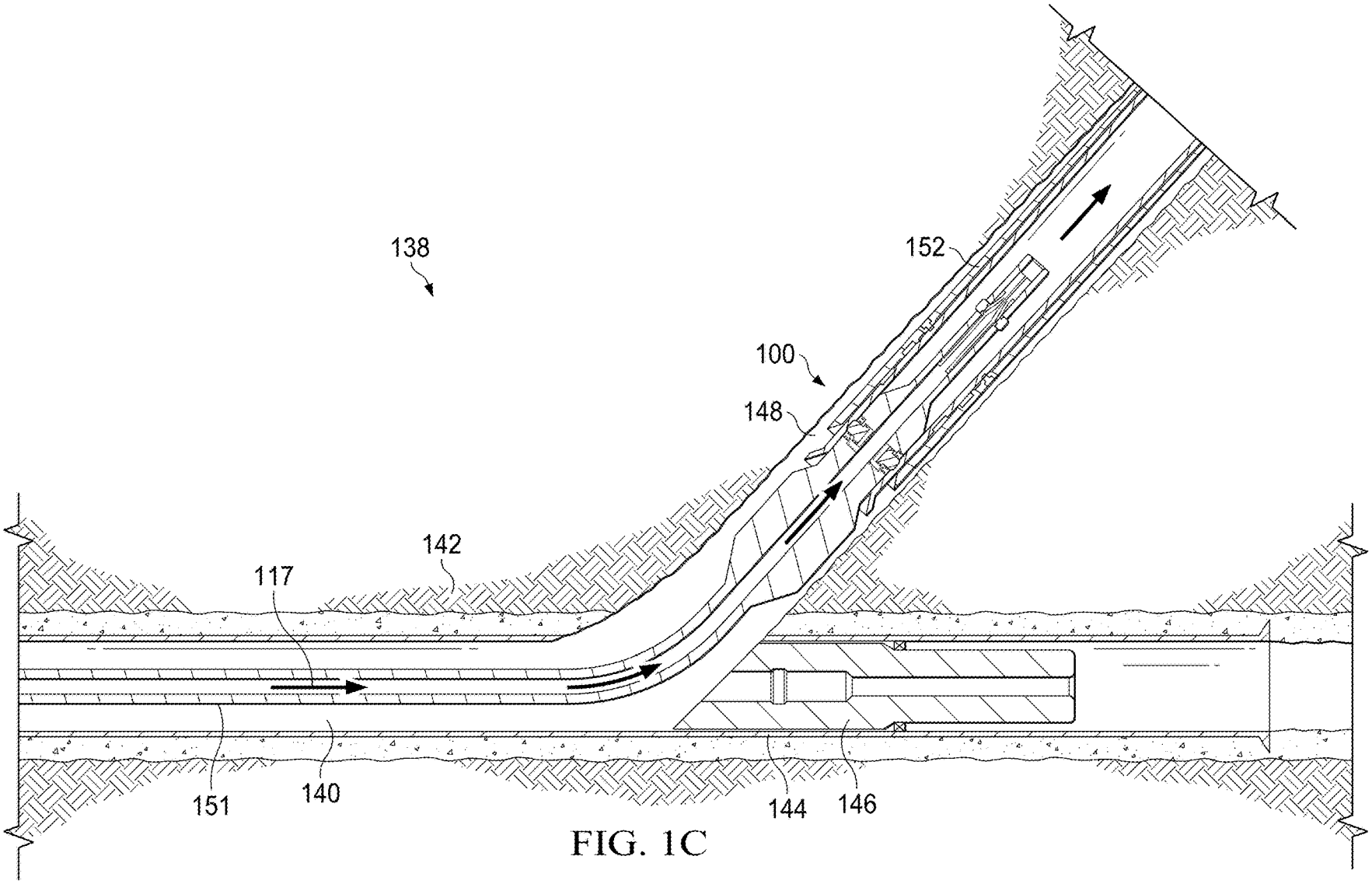
FIG. 1C illustrates running the ETJDS into a secondary wellbore of the well system, in accordance with examples of the present disclosure.

FIG. 1C illustrates the well system 138 in accordance with examples of the present disclosure. The ETJDS 100 may be run into the secondary wellbore 148 via the window 150 that is disposed between the primary wellbore 140 and the secondary wellbore 148. The ETJDS 100 may be run on a tubular string 151 at a top of (e.g., up-hole to) a tubular 152, such as for example, a liner, may be run below the ETJDS 100. The fluid 117 may pass through the tubular string 151 including the ETJDS 100 and tubular 152. In some examples, one or more features of ETJDS 100 may be formed, or be considered part of, tubular 152 or a component of tubular 152.

Figure 1D:
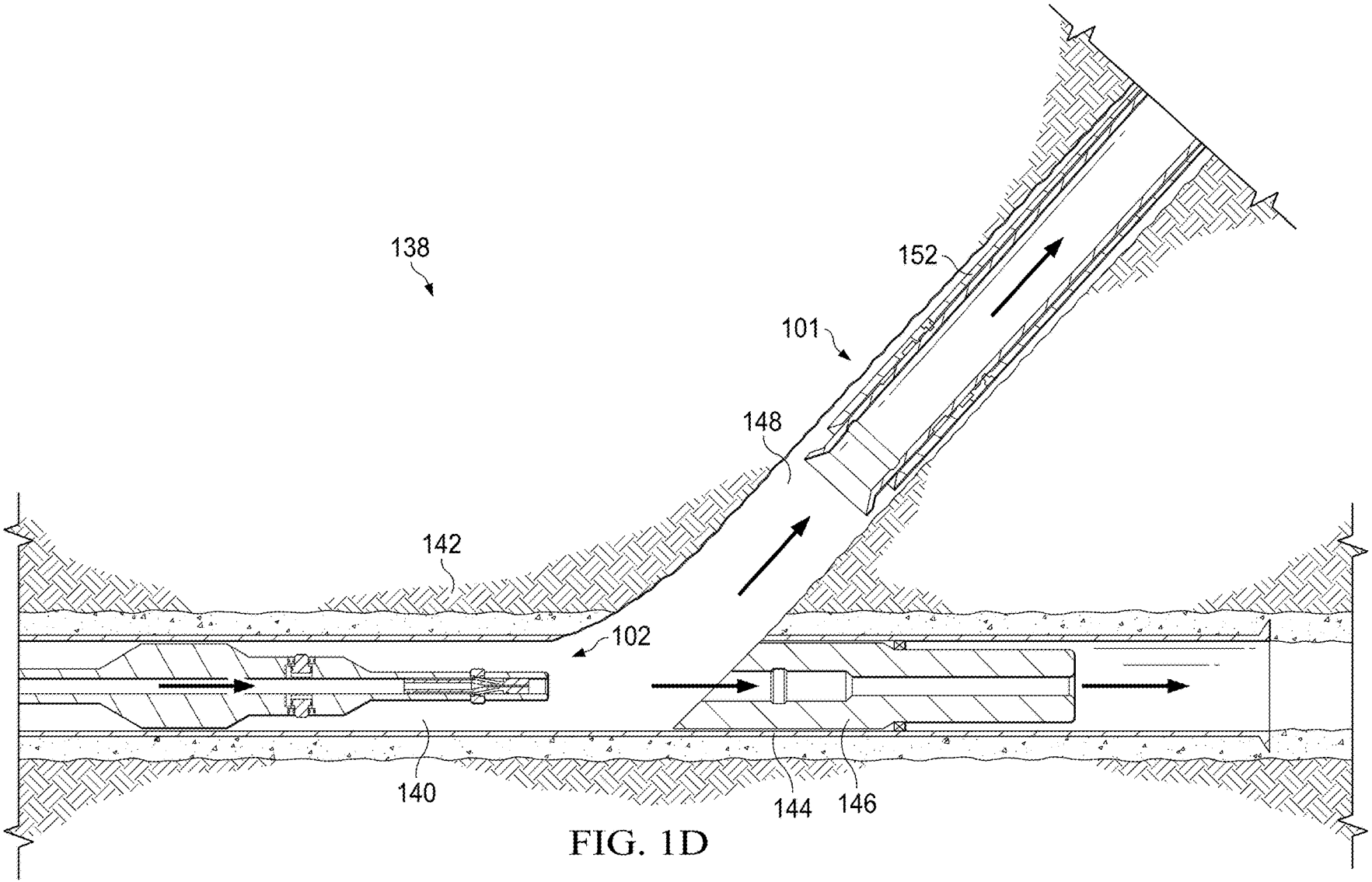
FIG. 1D illustrates releasing the ETJ into the secondary wellbore, in accordance with examples of the present disclosure.

FIG. 1D illustrates the well system 138 in accordance with examples of the present disclosure. The ETJDT 102 may release the ETJ 101 into the secondary wellbore 148, and the ETJDT 102 may be pulled back up-hole into the primary wellbore 140 for alignment with the whipstock 146 that is disposed in the primary wellbore 140.

Figure 1E:
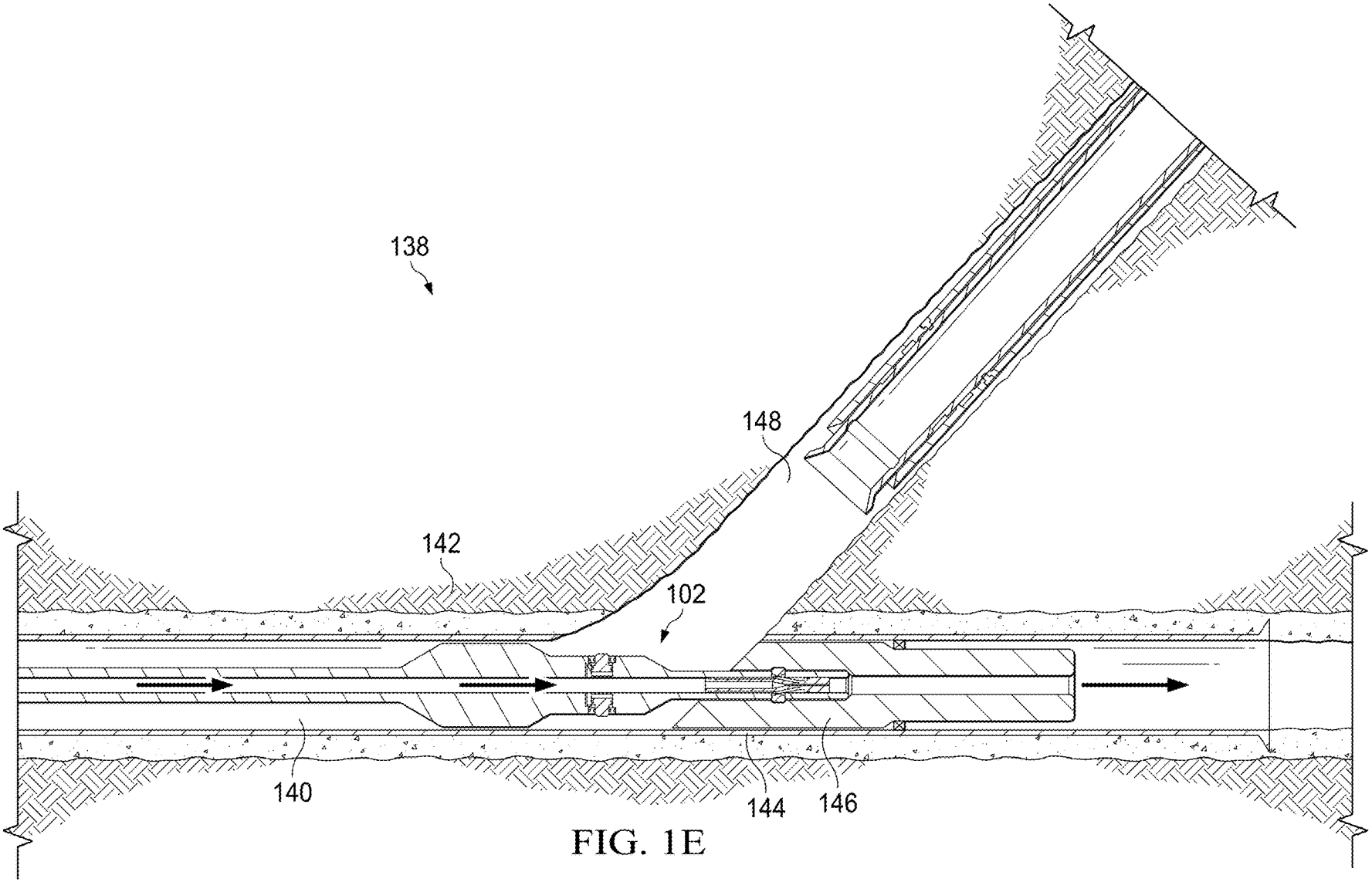
FIG. 1E illustrates engagement of a whipstock for removal from a primary wellbore of the well system, in accordance with examples of the present disclosure.

FIG. 1E illustrates the well system 138 in accordance with examples of the present disclosure. The ETJDT 102 may engage the whipstock 146 (or other device) within the primary wellbore 140 and pull the whipstock 146 out of the primary wellbore 146.

Figure 1F:
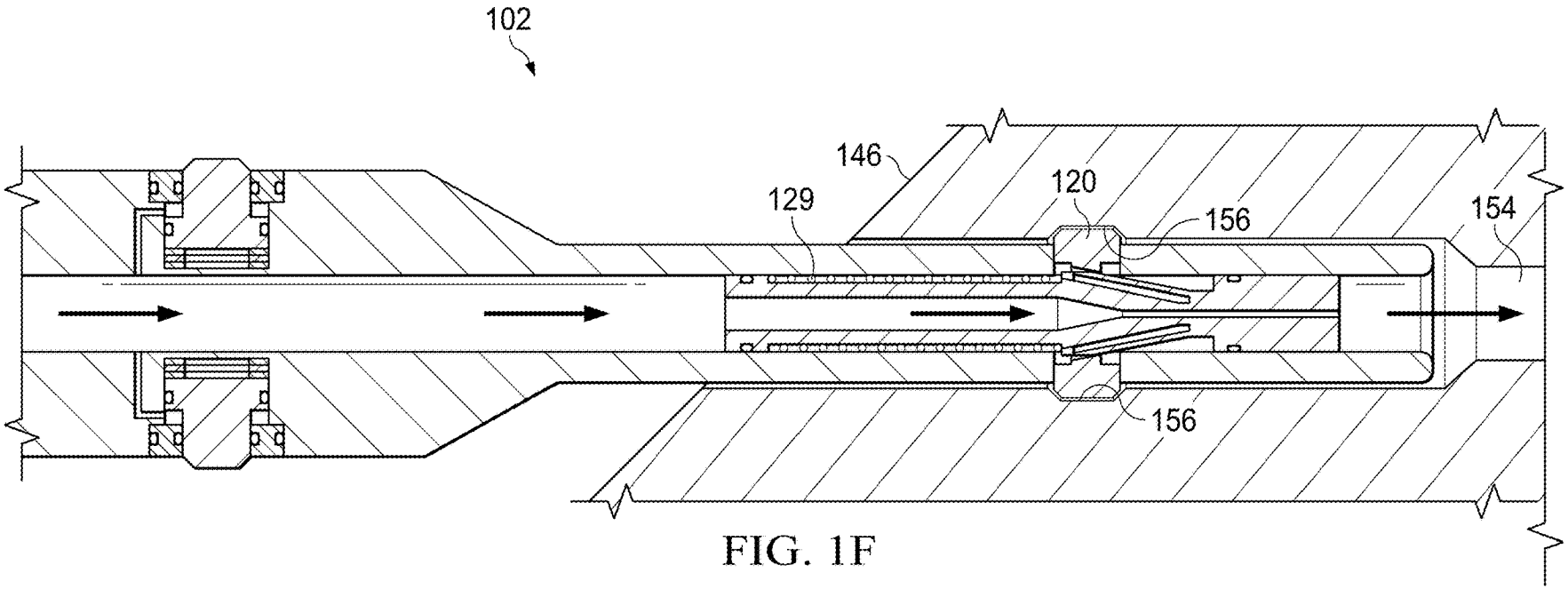
FIG. 1F illustrates a close-up view of an ETJ deployment tool in the well system, in accordance with examples of the present disclosure.

FIG. 1F illustrates a close-up view of the ETJDT 102 engaged to the whipstock 146, in accordance with examples of the present disclosure. The whipstock 146 may include a bore 154 to receive the ETJDT 102. The spring 129 way be extended such that the dogs 120 are protruding into recesses 156 of the whipstock 146 to engage the whipstock 146 for removal. Other devices besides from a whipstock 146 may be affected by ETJDT 102, for example, a no-go ring, a seal protective sleeve, plug, etc.

Figure 2A:
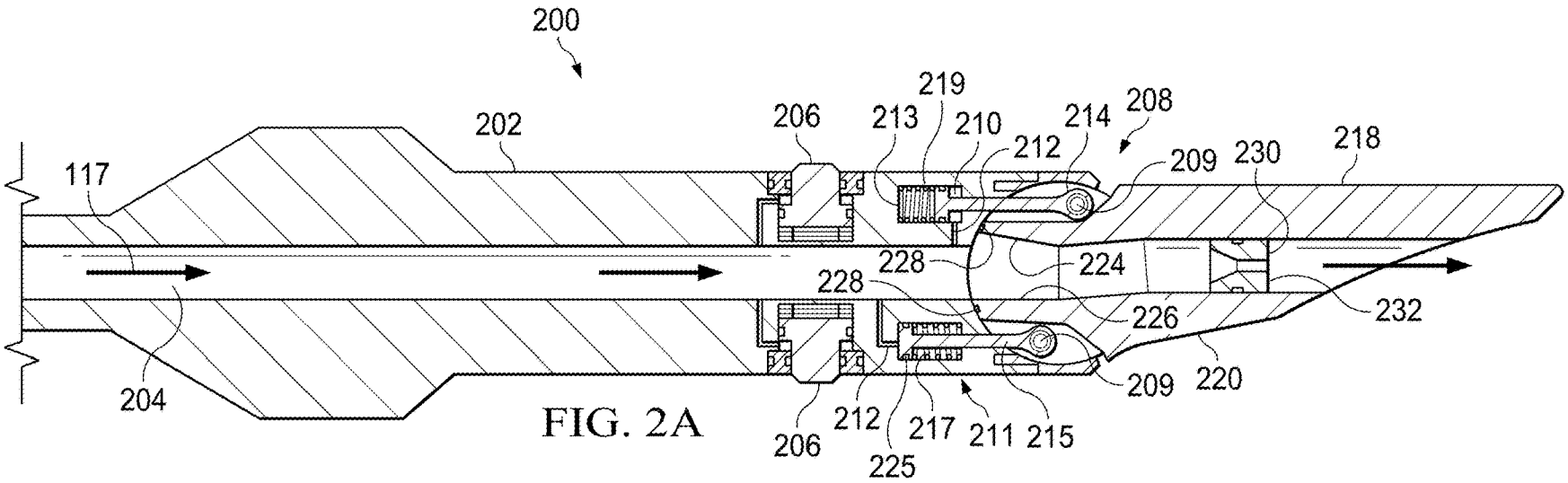
FIG. 2A illustrates a completion deflector running tool (CDRT), in accordance with examples of the present disclosure.

FIG. 2A illustrates a CDRT 200, in accordance with examples of the present disclosure. The CDRT 200 may include a body 202 with a central bore 204 extending lengthwise through the body 202. The body 202 may be sized to fit within various sized tubulars. At least one dog 206 may be operable to engage a CD and the ETJ 101. The dog 206 may be similar to the dog 114 (shown on FIG. 1).

A distal end 208 of the CDRT 200 may include chambers 210 and 211 which may each be in fluid communication with the fluid 117 via a port 212 (e.g., a hole). The chambers 210 and 211 may be disposed on opposing sides of the central bore 204.

Members 214 and 215 may be elongated and at least partially disposed within the chambers 210 and 211, respectively. A compression spring 217 may be disposed in each of the chambers 210 and 211. Upon the chamber 210 receiving the fluid 117, via the port 212, the member 214 may retract, for example, in an up-hole direction. Upon the chamber 211 receiving the fluid 117, the member 215 may extend, for example, in a downhole direction. Each of the chambers 210 and 211 may include vent holes 213. Seals 225 (e.g., O-ring) may be disposed around each of the members 214, as shown. When the CDRT 200 has not been actuated/angled (e.g., straight orientation as shown), the spring 217 is extended to extend the member 214, and the spring 219 is extended to retract the member 215.

Each of guides 218 and 220 may be elongated members rotatably attached to the members 214 and 215, for example, with pins 209 (e.g., wrist pins). As fluid pressure increases, the guides 218 and 220 may rotate. For example, the member 214 may retract to rotate the guide 218 outward. The member 215 may extend to rotate the guide 220 inward. Both guides 218 and 220 may move to position the CDRT 200 into a wellbore. A proximal end 224 of the guide 218 may include curvature operable to move the guide 218 outward. A proximal end 226 of the guide 220 may include curvature operable to move the guide 220 inward. The proximal ends 224 and 226 may also include seals 228 (e.g., O-rings).

Additionally, a protrusion 230 of the guide 218 may be positioned opposite to a protrusion 232 of the guide 220. Both protrusions may be operable to form a nozzle (e.g., a pressure drop nozzle) for egress of the fluid 117 from the CDRT 200. In some examples, the protrusions 230 and 232 are a single circular part (e.g., a nozzle) typically made of tungsten carbide for erosion resistance.

Figure 2B:
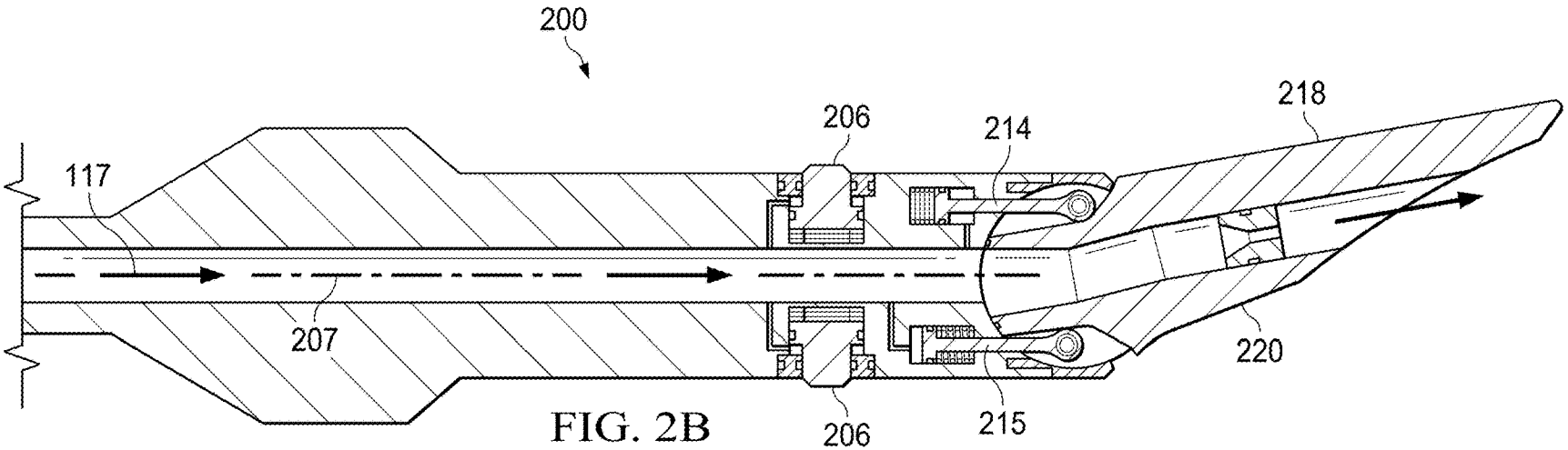
FIG. 2B illustrates the CDRT actuated, in accordance with examples of the present disclosure.

FIG. 2B illustrates the CDRT 200 in an angled orientation, in accordance with examples of the present disclosure. As fluid pressure increases within the CDRT 200, the fluid 117 may cause the dogs 206 and the member 214 to retract causing the guide 218 to move (e.g., rotate) outward relative to a central axis 207 of the CDRT 200. The member 215 may extend in a downhole direction causing the guide 220 to move inward relative to the central axis 207 of the CDRT 200. The guides 218 and 220 may be the same piece/part to form a single guide. The member 215 may push at the same time member 214 pulls to produce a torque (moment) to urge the guides 218 and 220 to rotate counter-clockwise about its axis. This causes the tip of the guides 218 and 220 to move away from the central axis 207. When fluid pressure is decreased (close to zero psi), the springs 217 (e.g., shown on FIG. 2A) push against the members 214 and 215 to urge the guides 218 and 220 to rotate clockwise about its axis. In most examples, the guides 218 and 220 are one circular part.

Figure 2C:
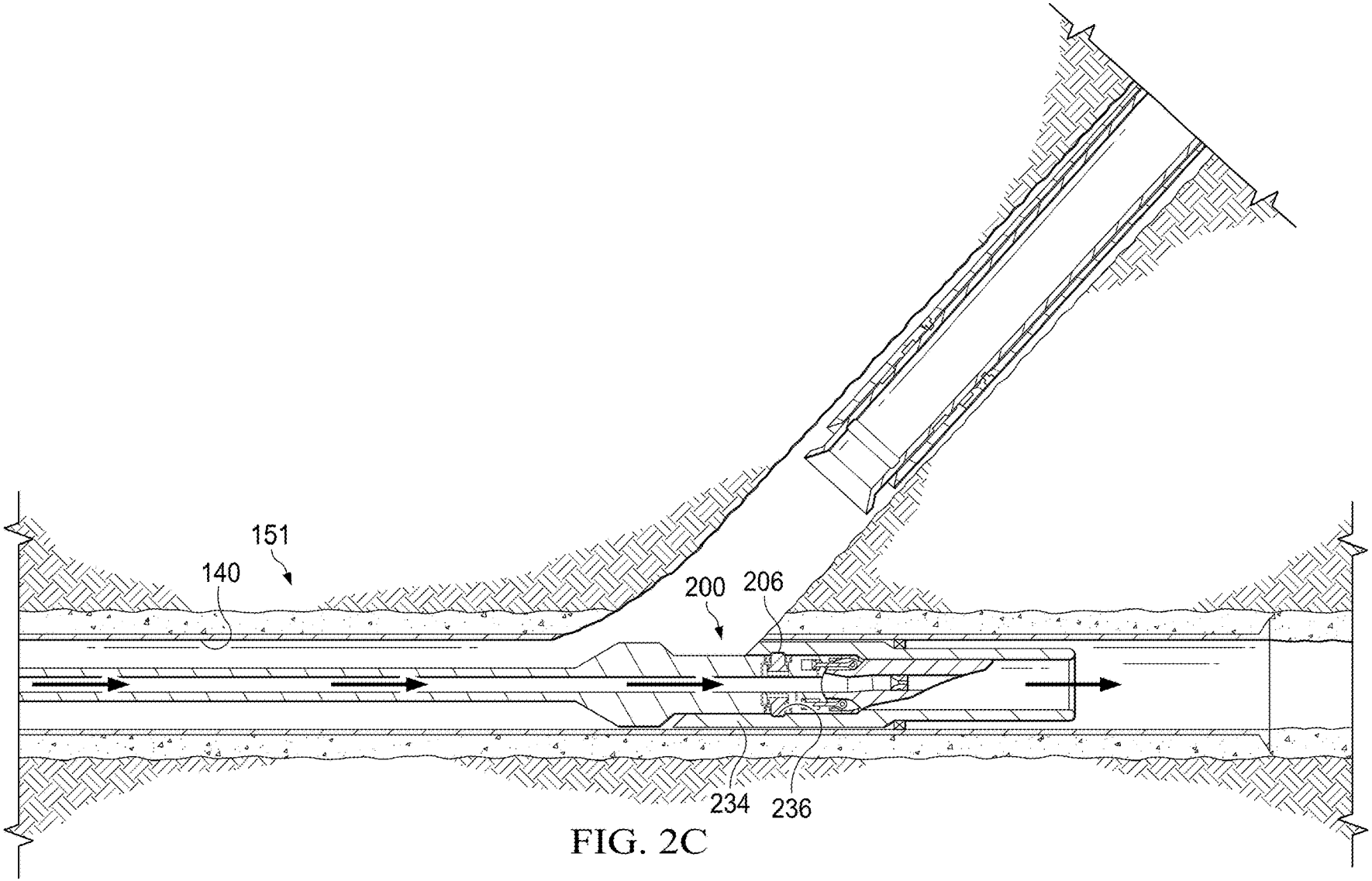
FIG. 2C illustrates the CDRT run into the primary wellbore, in accordance with examples of the present disclosure.

FIG. 2C illustrates a CD 234 being landed into the primary wellbore 140 with the CDRT 200, in accordance with examples of the present disclosure. The CDRT 200 may be run on the tubular string 151, in some examples. The dogs 206 may engage recesses 236 of the CD 234. After landing the CD 234, in one or more examples, pressure may be applied at the surface to the CDRT 200; a moderate amount of pressure/flow applied to fluid 117 will increase the force exerted onto dogs 206 so that springs 119 (e.g., Belleville spring) and the dogs 206 will collapse/retract. This may allow the CDRT 200 to be released from CD 234. In some examples, a moderate amount of pressure/flow may be defined as 100-psi to 2,000-psi and a flow rate of 42 gpm to 420 gpm, 300-psi to 1,000-psi and a flow rate of 84 gpm to 210 gpm, or other values depending on well conditions, fluid conditions and/or other tools and/or desired parameters such as limiting the ECD (Equivalent Circulating Density).

Figure 2D:
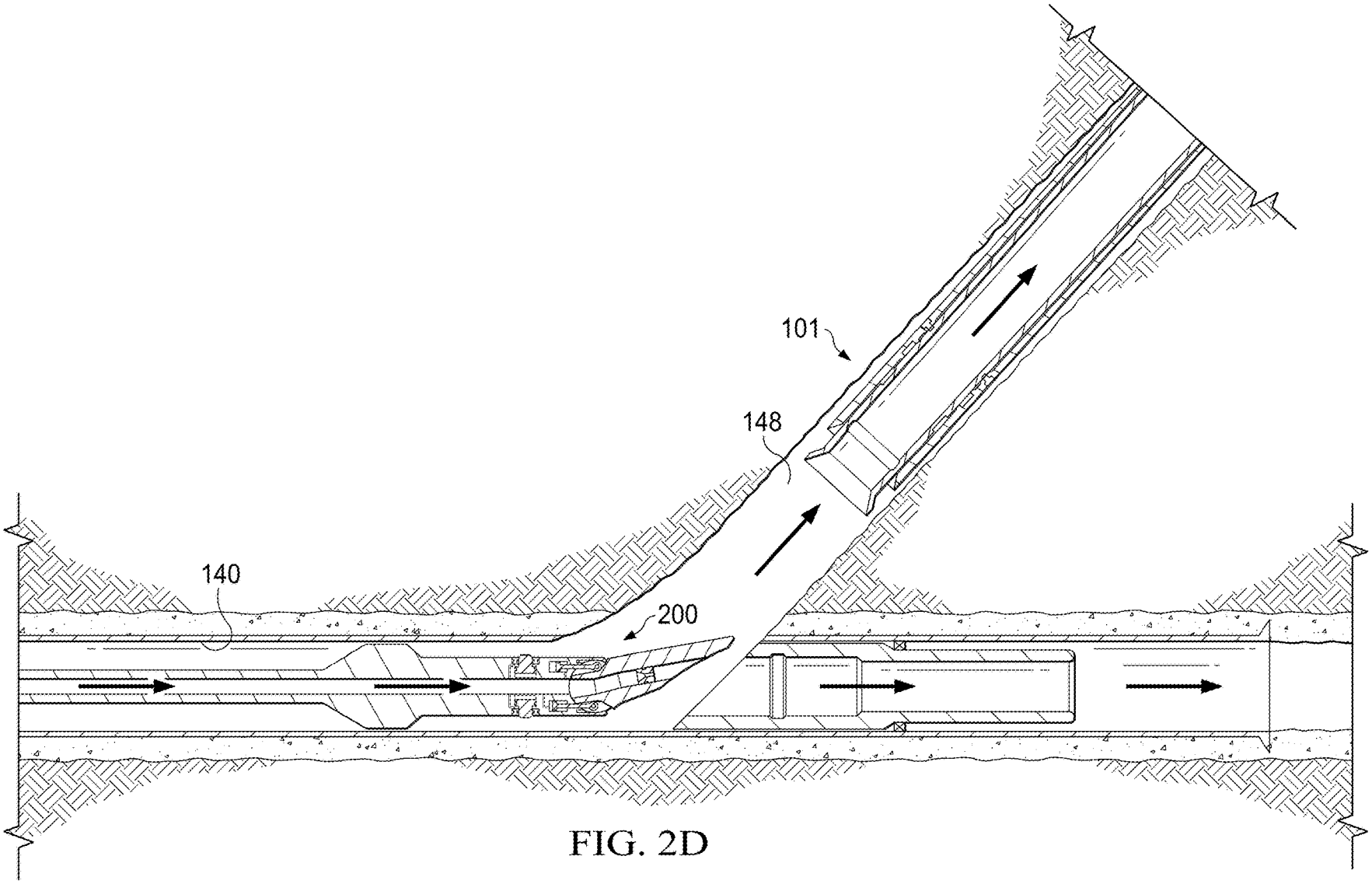
FIG. 2D illustrates the CDRT aligning with the ETJ in the secondary wellbore, in accordance with examples of the present disclosure.

FIG. 2D illustrates the CDRT 200 after being released from the CD 234 that is disposed in the primary wellbore 140, in accordance with examples of the present disclosure. After the CDRT 200 has been disengaged from the CD 234 and pulled uphole as shown, additional flow may be introduced from the surface to overcome the resistance of springs 217 to extend the member 215 and retract member 214 which urges the guides 218 and 220 to rotate for passing into the secondary wellbore 148 to engage the ETJ 101.

Figure 2E:
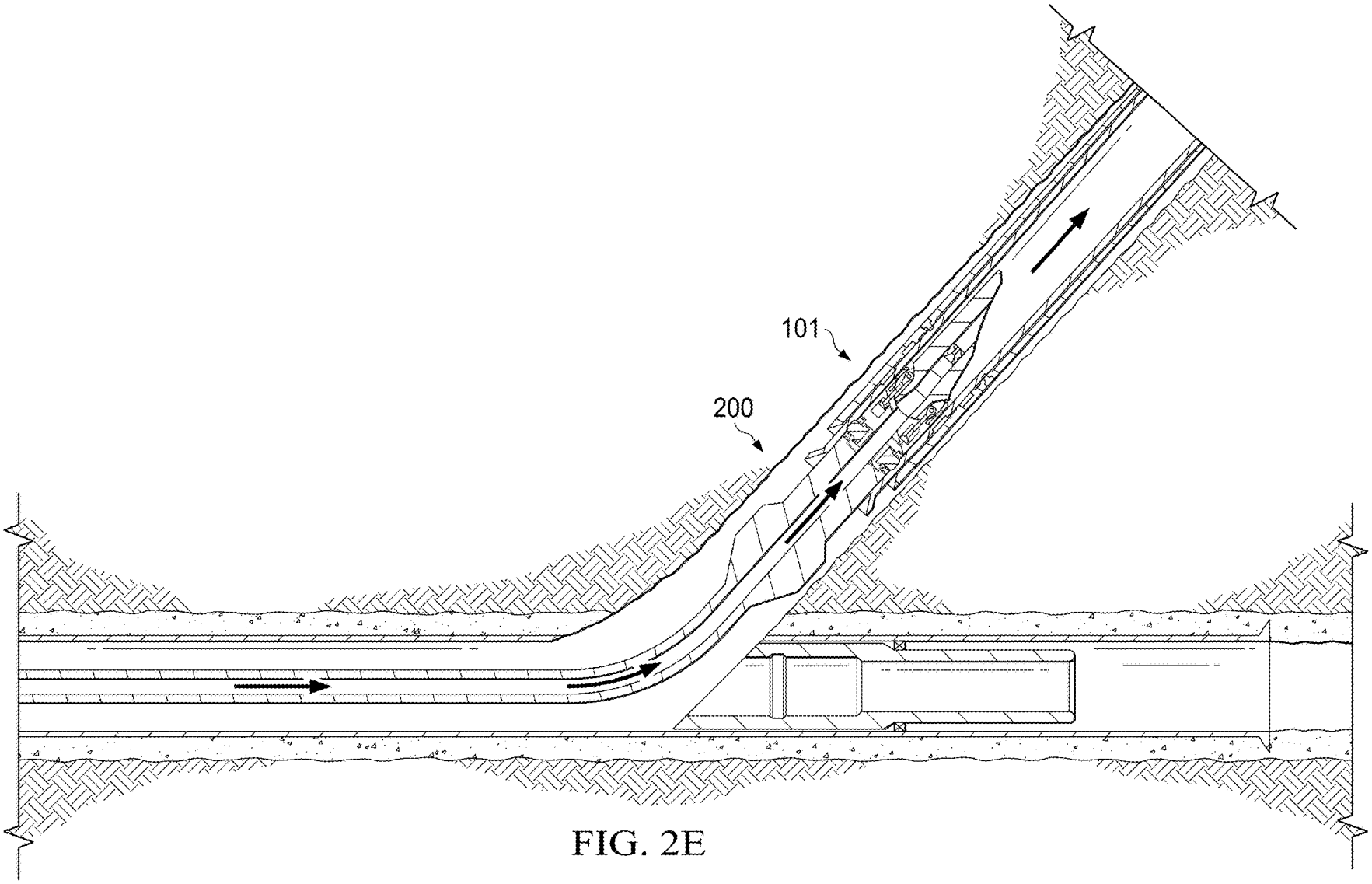
FIG. 2E illustrates the CDRT engaging the ETJ, in accordance with examples of the present disclosure.
Figure 2F:
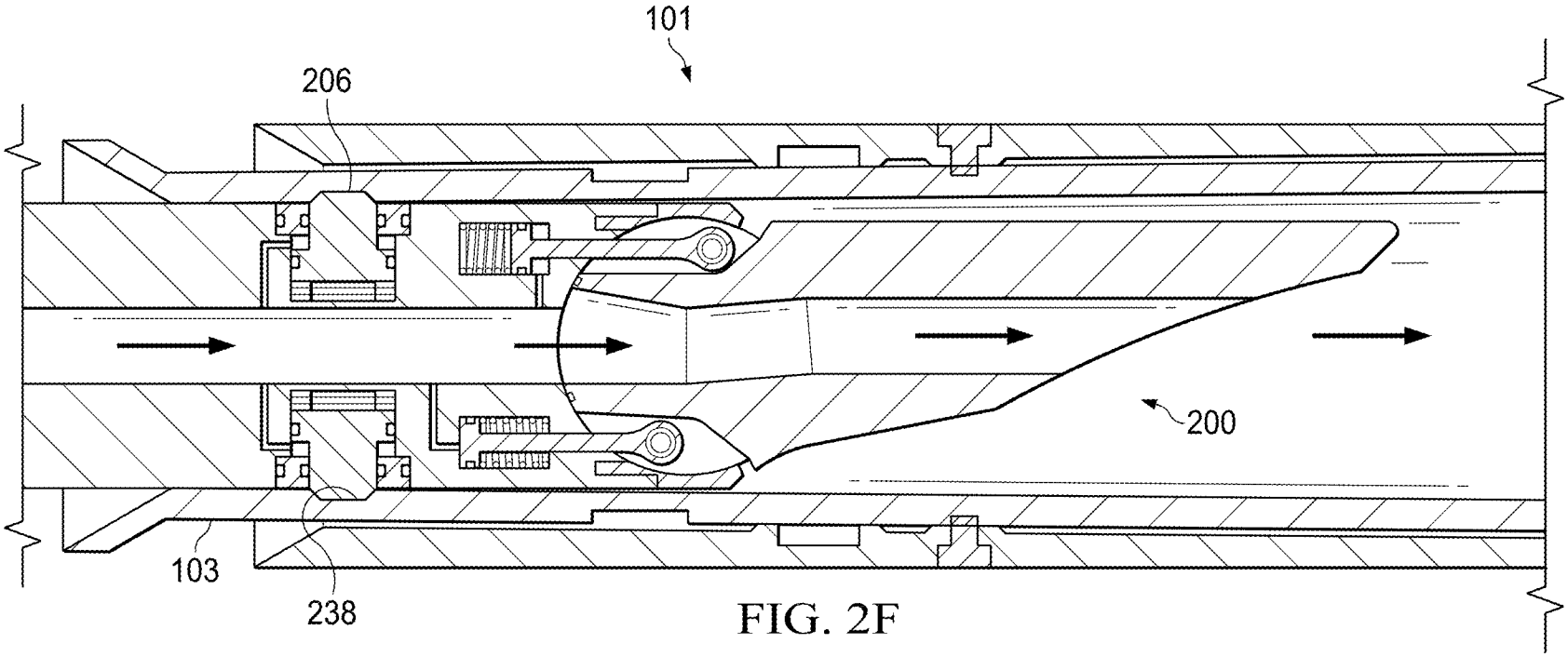
FIG. 2F illustrates a close-up view of the CDRT engaging the ETJ, in accordance with examples of the present disclosure.

FIGS. 2E and 2F illustrate the CDRT 200 engaging the ETJ 101, in accordance with examples of the present disclosure. The dogs 206 of the CDRT 200 may be expanded to engage recesses 238 of the ETJ 101 by reducing flow. FIG. 2F illustrates a close-up view of the engagement of the dogs 206 of the CDRT 200 with the recesses 238 of the first member 103 of the ETJ 101. In one or more examples, pressure/flow may be applied at the surface to the CDRT 200; a medium pressure/medium flow rate may be applied so the lateral wellbore can be flushed of debris. The medium pressure/medium flow may be low enough to prevent the guides 218 and 220 from rotating into the position shown in FIG. 2B. The medium pressure/medium flow may be high enough to prevent the dogs 206 from extending outwards as shown in FIG. 2A.

Figure 2G:
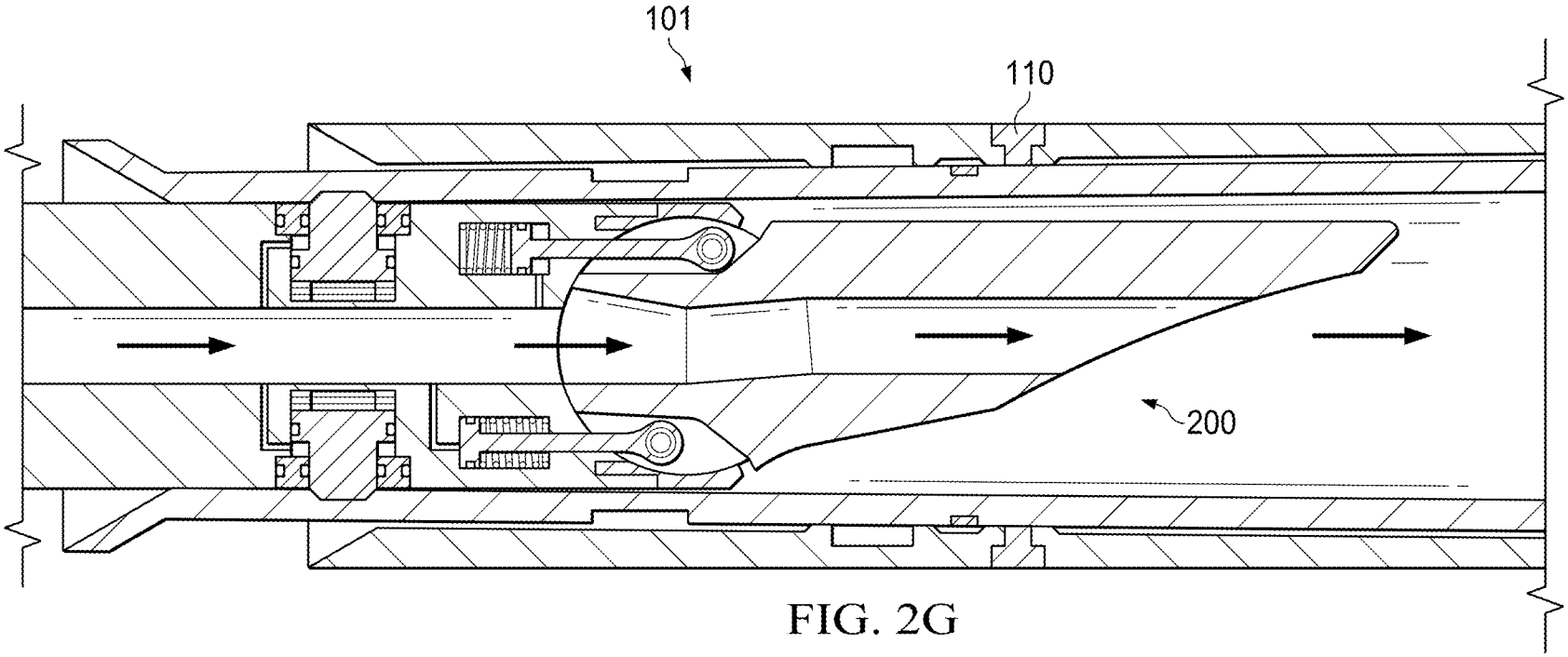
FIG. 2G illustrates a close-up view of the CDRT extending the ETJ, in accordance with examples of the present disclosure.

FIG. 2G illustrates a close-up view of the CDRT 200 extending the ETJ 101, in accordance with examples of the present disclosure. In one example, the shear screws 110 may be sheared as the first member 103 of the ETJ 100 is extended from the second member 104 of the ETJ 101, with the CDRT 200. The CDRT 200 may provide sufficient force in an up-hole direction to shear the shear screws 110 to extend the ETJ 100.

Figure 2H:
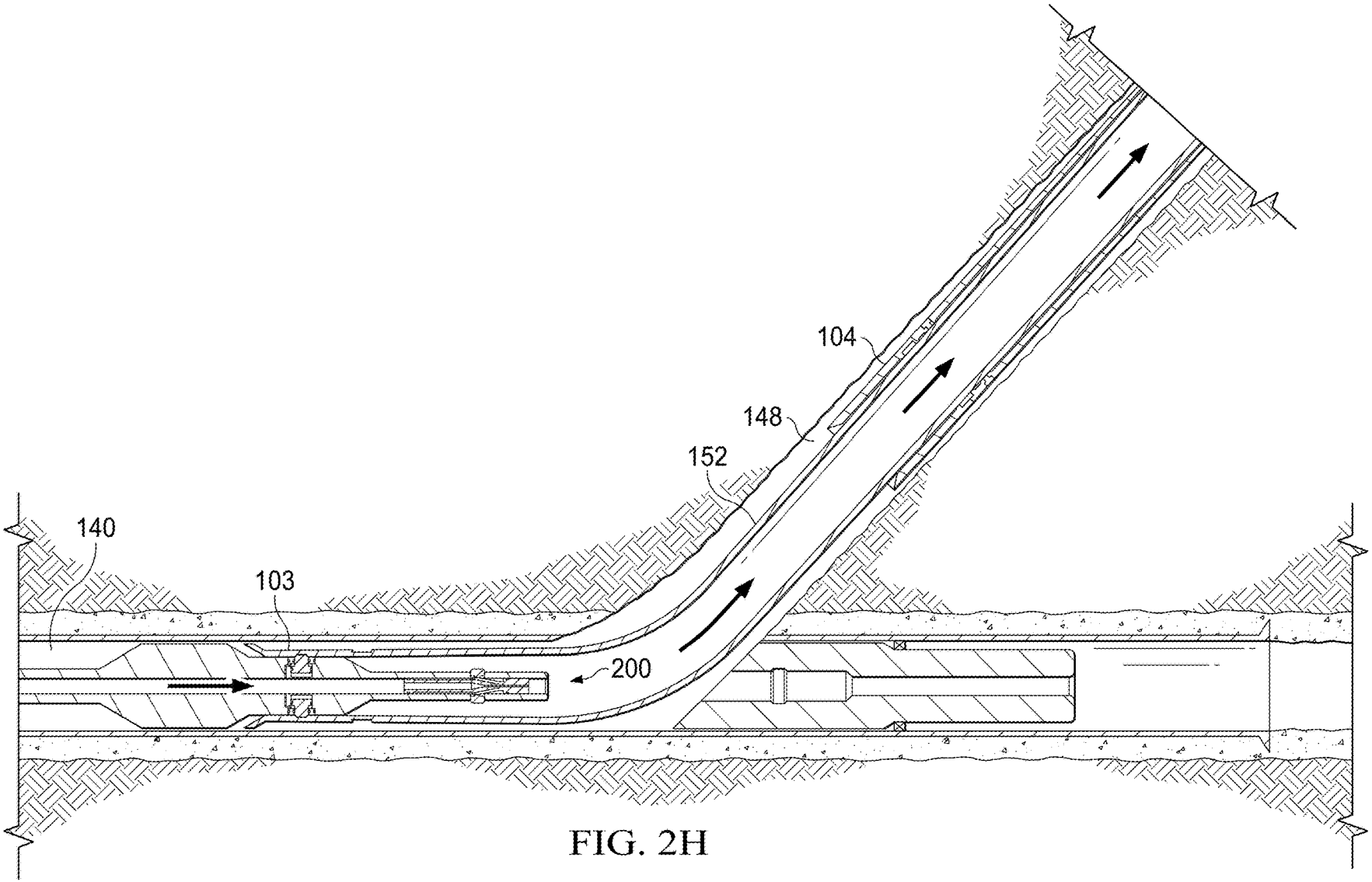
FIG. 2H illustrates the CDRT extending the ETJ into the primary wellbore, in accordance with examples of the present disclosure.

FIG. 2H illustrates the CDRT 200 extending the first member 103 of the ETJ 101, in accordance with examples of the present disclosure. The CDRT 200 may be pulled up-hole to extend the first member 103 of the ETJ 100 in an up-hole direction such as into the primary wellbore 140. The second member 104 of the ETJ 101 (and the tubular 152) may remain in the secondary wellbore 148.

Figure 2I:
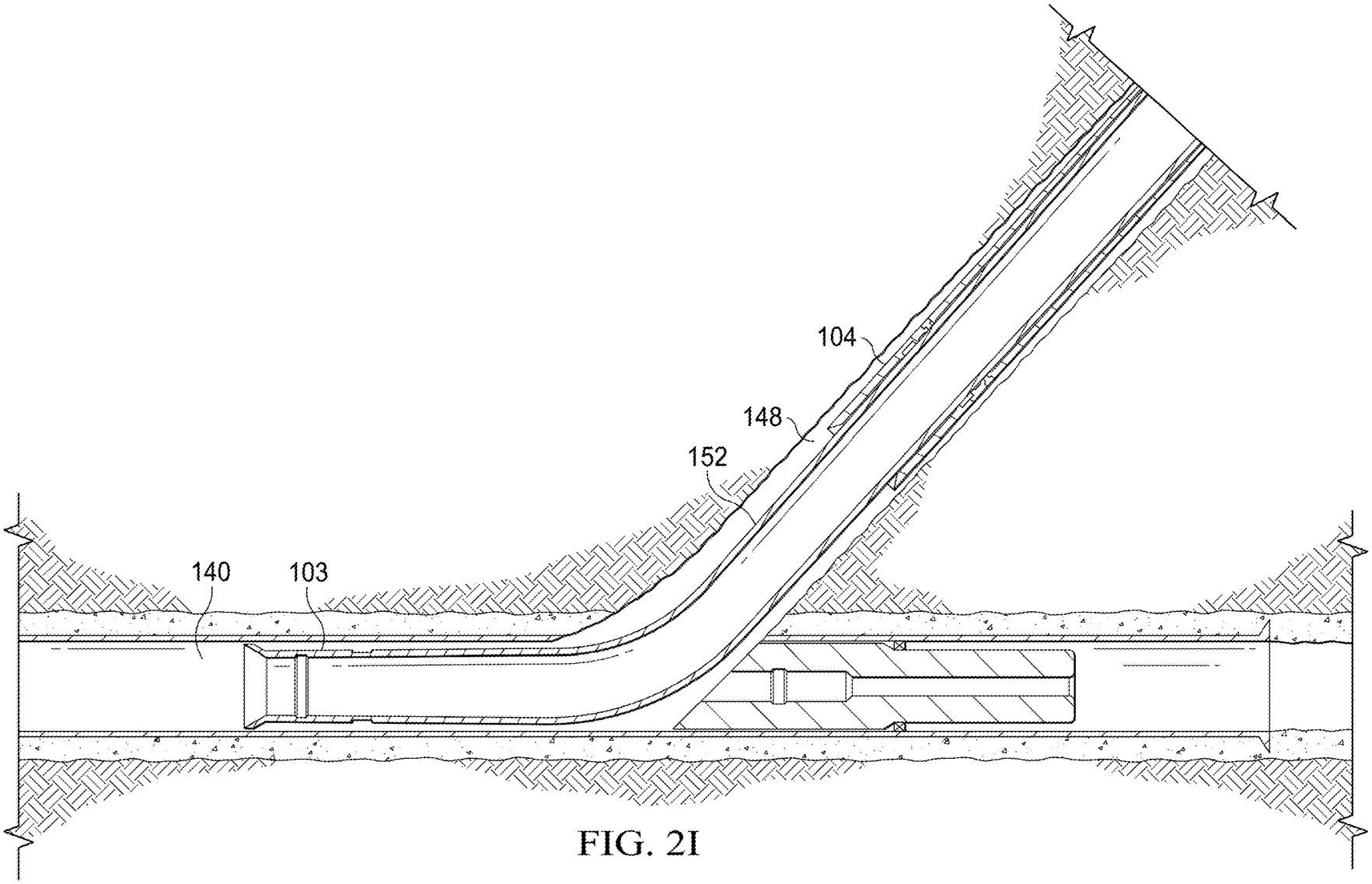
FIG. 2I illustrates the extended ETJ, in accordance with examples of the present disclosure.

FIG. 2I illustrates the first member 103 of the ETJ 100 extended from the second member 104, in accordance with examples of the present disclosure. The CDRT 200 (shown on FIG. 2H) has disengaged from the ETJ 100 and has been pulled out of the primary wellbore 140. The first member 103 extends from the secondary wellbore 148 to the primary wellbore 140.

Figure 2J:
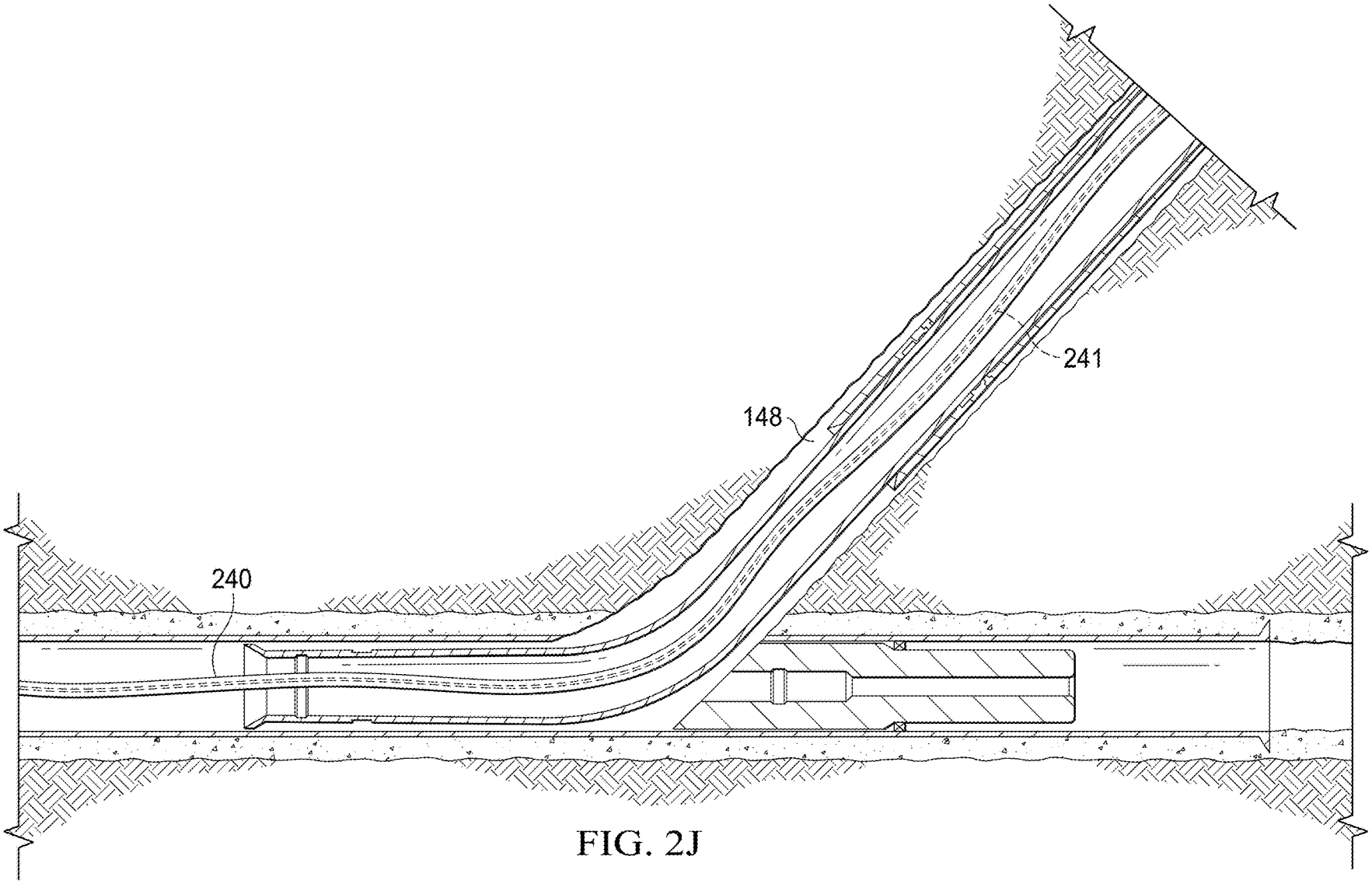
FIG. 2J illustrates a completion string being run into the well system, in accordance with examples of the present disclosure.

FIG. 2J illustrates a completion string 240 (e.g., 3½ inch diameter) run into the secondary wellbore 148, in accordance with examples of the present disclosure. The completion string 240 may include a control line 241.

Figure 2K:
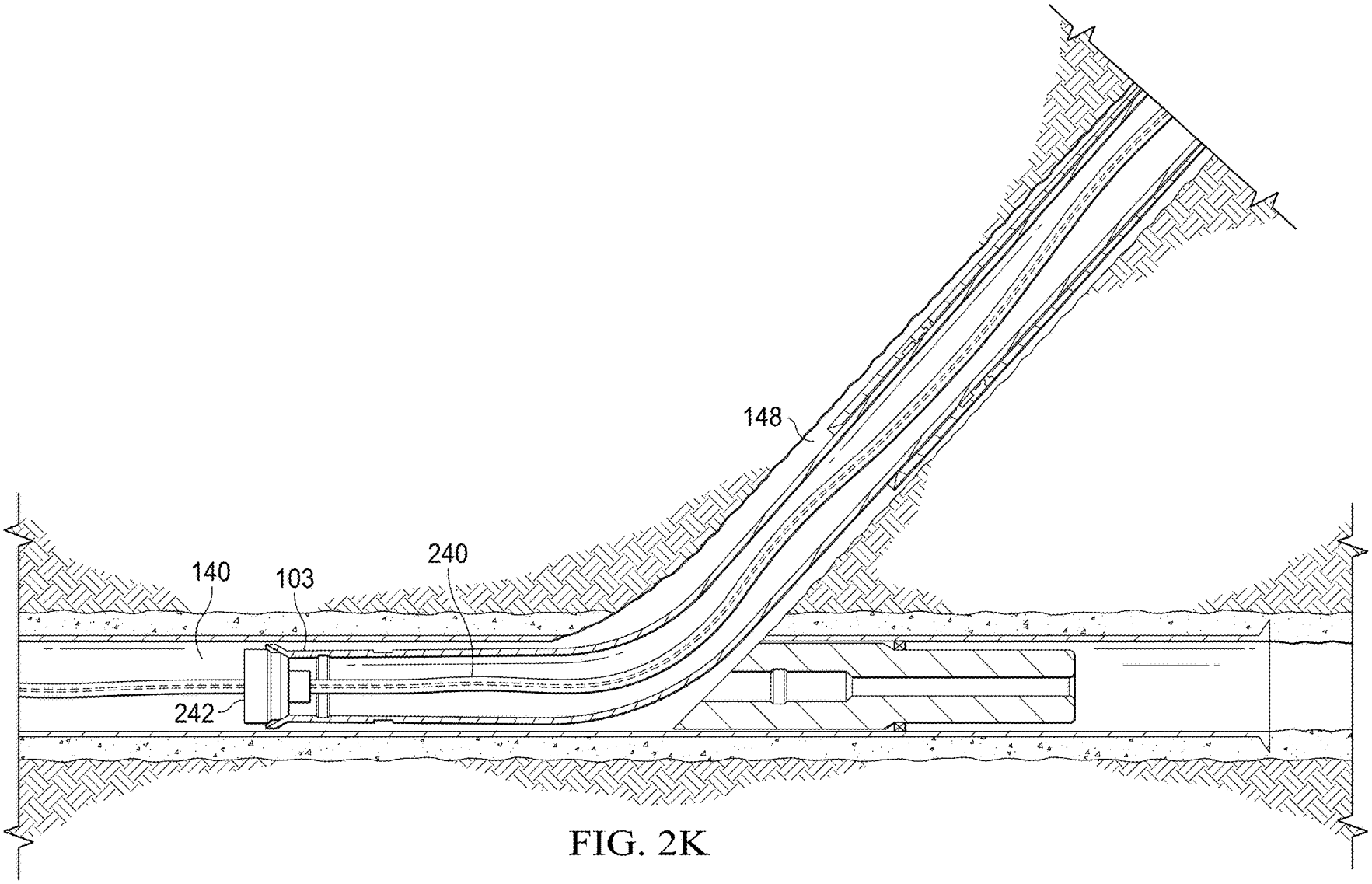
FIG. 2K illustrates a device to retract the ETJ into the secondary wellbore, in accordance with examples of the present disclosure.

FIG. 2K illustrates a device 242 disposed on an up-hole/upper end of the completion string 240, in accordance with examples of the present disclosure. The device 142 may include a profile to push against the member 103 to retract the member 103 into the secondary wellbore 148. This provides full-bore access again to the primary wellbore 140. In some examples, the device 242 may include a No-Go (e.g., a stop feature), shoulder, or the lower end of a multilateral junction.

Figure 2L:
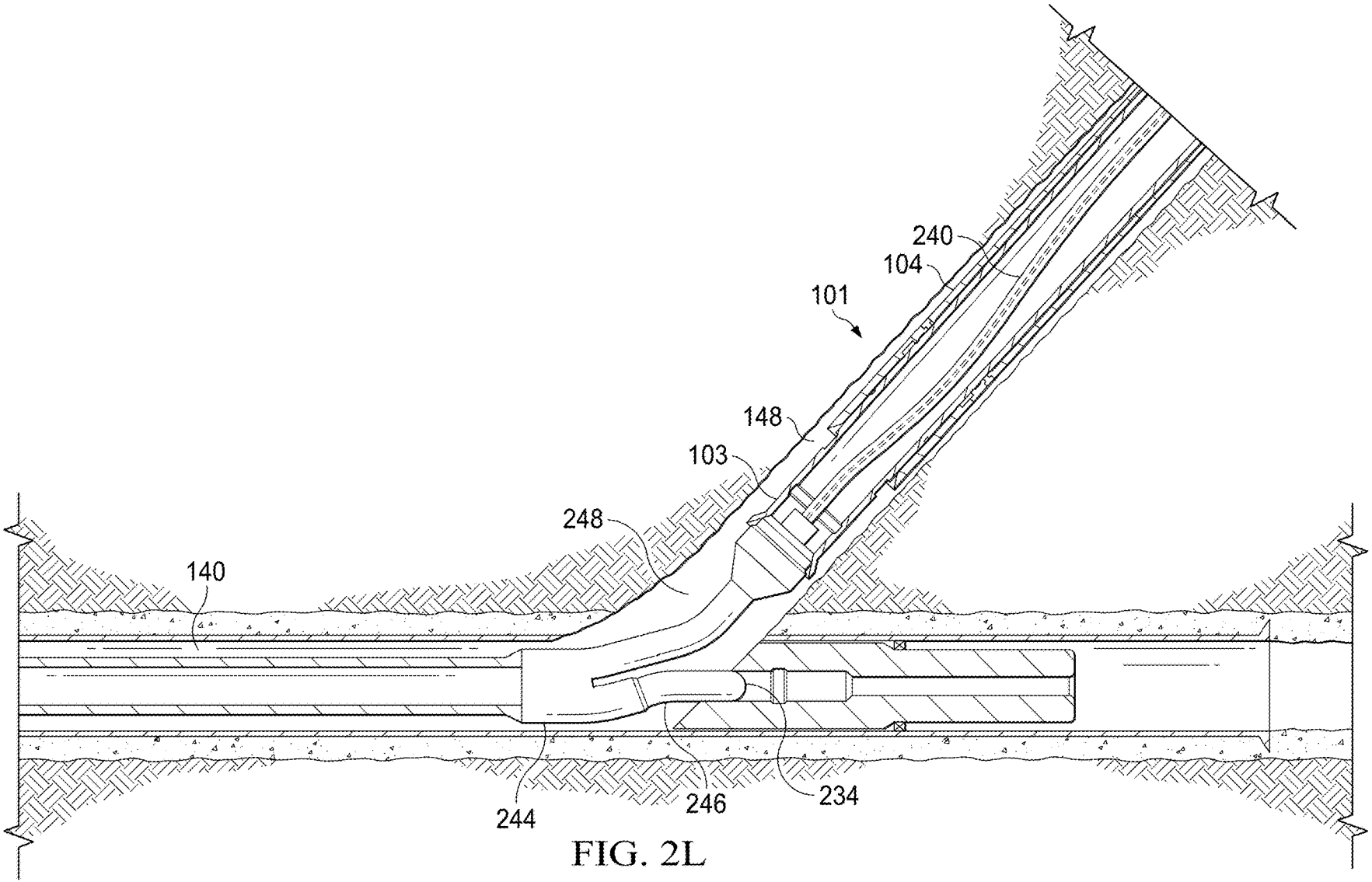
FIG. 2L illustrates a multilateral junction being run into the primary and secondary wellbores, in accordance with examples of the present disclosure.

FIG. 2L illustrates a junction 244 being run into the primary wellbore 140 and the secondary wellbore 148. A first portion 246 of the junction 244 may engage the CD 234 and a second portion 248 of the junction 244 may be coupled to the completion string 240. The member 103 of the ETJ 101 may be retracted into the second member 104 within the secondary wellbore 148. In one or more examples, the member 103 is locked into a position in the second member 104. The junction 244 may include a multi-bore junction assembly, including a main bore leg and a lateral bore leg, may be lowered into the main wellbore to a junction between the main and lateral wellbores. The multi-bore junction assembly may then be secured within the multilateral wellbore by extending the lateral bore leg into the lateral wellbore and simultaneously stabbing the main bore leg into a completion deflector arranged within the main wellbore. Once positioned and secured within the lateral wellbore, the lateral bore leg may then be used for completion and production operations in the lateral wellbore.

Figure 2M:
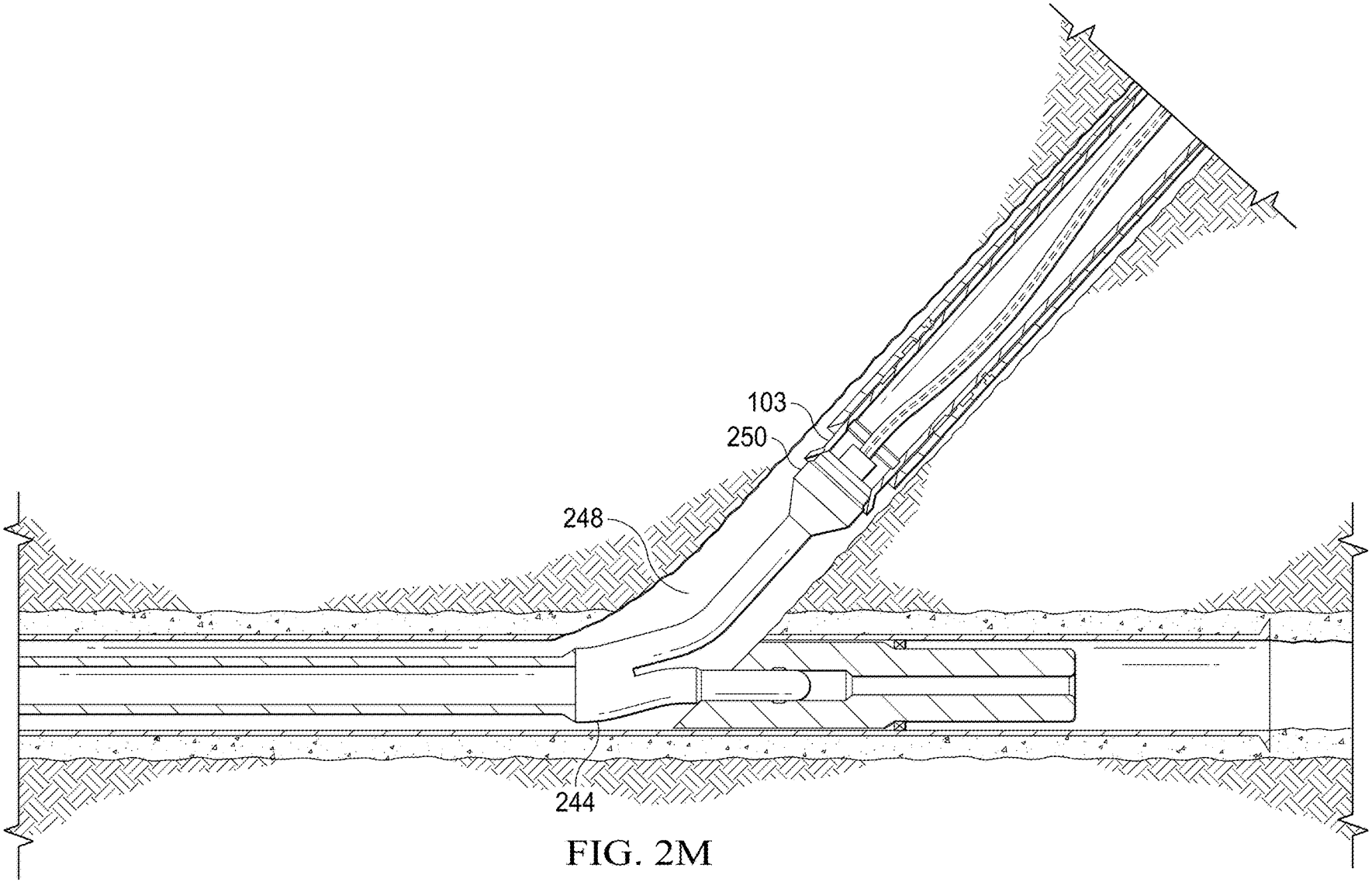
FIG. 2M illustrates another device to retract the ETJ into the secondary wellbore, in accordance with examples of the present disclosure.

FIG. 2M illustrates a device 250 which may push the first member 103 into a retracted position, in accordance with examples of the present disclosure. The device 250 may be located near to the second member 248 of the junction 244 and the first member 103.

Figure 3:
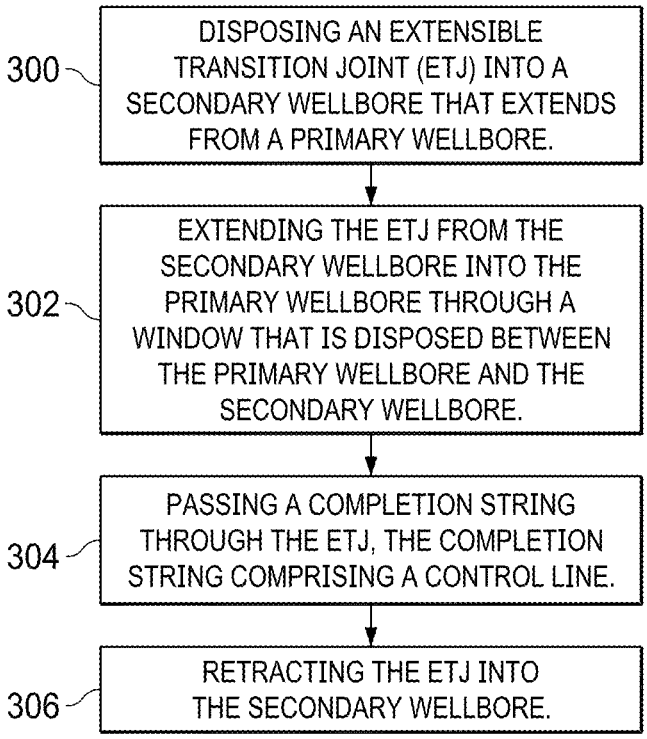
FIG. 3 illustrates an operative flowchart, in accordance with examples of the present disclosure.

FIG. 3 illustrates an operative flowchart, in accordance with examples of the present disclosure. At step 300, an extensible transition joint (ETJ) may be disposed in a secondary wellbore (e.g., FIG. 1D). At step 302, the ETJ may be extended from the secondary wellbore into the primary wellbore through a window that is disposed between the primary wellbore and the secondary wellbore (e.g., FIG. 2H). At step 304, a completion string may be passed through the ETJ. The completion string may include a control line (e.g., FIG. 2J). At step 306, the ETJ may be retracted into the secondary wellbore (e.g., FIG. 2K).

Accordingly, the systems and methods of the present disclosure may allow for safe passage of control lines through junctions that may be encountered in a downhole environment. The systems and methods may include any of the various features disclosed herein, including one or more of the following statements.

Statement 1. An extensible transition joint deployment tool (ETJDT) comprising: a tool body comprising a central bore; at least one first component and at least one second component, each component operable to extend and retract laterally from the tool body, wherein the at least one second component is disposed at an axial distance from the at least one first component along the tool body; a member disposed within the central bore and operable to move; and a spring disposed axially between a portion of the member and the at least one second component.

Statement 2. The ETJDT of the statement 1, wherein the at least one first and the at least one second component are different sizes.

Statement 3. The ETJDT of the statement 2, wherein the at least one first component is movably disposed within a chamber that is in fluid communication with the central bore.

Statement 4. The ETJDT of any of the preceding statements, wherein a spring is disposed within the chamber, the spring operable to compress based on fluid pressure.

Statement 5. The ETJDT of any of the preceding statements, wherein the at least one second component is operable to extend or retract based on axially movement of the member within the central bore.

Statement 6. The ETJDT of any of the preceding statements, further comprising a retaining cap for each component.

Statement 7. The ETJDT of any of the preceding statements, further comprising a flow restrictor or pressure-drop device.

Statement 8. The ETJDT of any of the preceding statements, wherein the flow restrictor or pressure-drop device is disposed at a distal end of the tool body.

Statement 9. A completion deflector running tool (CDRT) comprising: a tool body comprising a central bore; at least one component operable to extend and retract laterally from the tool body; and a guide extending from a distal end of the tool body, the guide operable to rotate.

Statement 10. The CDRT of the statement 9, further comprising a fluid altering device disposed on the guide.

Statement 11. The CDRT of the statement 9 or the statement 10, further comprising chambers operable to rotate the guide.

Statement 12. The CDRT of any of the statements 9-11, further comprising a first member at least partially disposed in a first chamber.

Statement 13. The CDRT of any of the statements 9-12, further comprising a second member at least partially disposed in a second chamber, each member operable to move axially to orient the guide.

Statement 14. The CDRT of any of the statements 9-13, wherein the first member is operable to expand to orient the guide.

Statement 15. The CDRT of any of the statements 9-14, wherein the second member is operable to compress to orient the guide.

Statement 16. A method for passing a control line from a primary wellbore to a secondary wellbore, the method comprising: disposing an extensible transition joint (ETJ) into the secondary wellbore; extending the ETJ from the secondary wellbore into the primary wellbore through a window that is disposed between the primary wellbore and the secondary wellbore; and passing a completion string through the ETJ, the completion string comprising a control line.

Statement 17. The method of the statement 16, further comprising retracting the ETJ within the secondary wellbore.

Statement 18. The method of the statement 16 or the statement 17, further comprising unlocking the ETJ for extension.

Statement 19. The method of any of the statements 16-18, further comprising pushing a movable member of the ETJ to retract the movable member in the secondary wellbore.

Statement 20. The method of any of the statements 16-19, further comprising pushing the movable member of the ETJ to retract the movable member in the secondary wellbore by use of a completion string with one or more control lines.

Statement 21. The method of any of the statements 16-20, further comprising pushing the movable member of the ETJ to retract the movable member in the secondary wellbore by use of another tubular string.

Statement 22. The method of any of the statements 16-21, further comprising removing the completion string when the tubular string is unable to push the movable member.

Statement 23. The method of any of the statements 16-22, further comprising lowering a drill string to move the movable member in and out of the secondary wellbore to clear debris for the movable member.

Statement 24. The method of any of the statements 16-23, further comprising disposing a multi-bore junction assembly into the primary and secondary wellbores.

Statement 25. The method of any of the statements 16-24, further comprising pushing a movable member of the ETJ to retract the movable member in the secondary wellbore by use of a multi-bore junction assembly.

Statement 26. An extensible transition joint (ETJ) for a primary wellbore and a secondary wellbore, comprising: a first member; a second member, wherein the first member is movably disposed in the second member to retract into the secondary wellbore from the primary wellbore; and a lock operable to secure the first member relative to the second member to provide different positions of the first member relative to the second member.

Statement 27. The ETJ of the statement 26, wherein the first member is operable to move due to a pull force and/or a fluid pressure.

Statement 28. The ETJ of the statement 26 or the statement 27, wherein the first member is operable for pull back into the primary wellbore from the secondary wellbore.

Statement 29. The ETJ of any of the statements 26-28, wherein the first member is operable to extend from a retracted position.

Statement 30. The ETJ of any of the statements 26-29, further comprising a stop feature operable to stop the first member from completely separating or overextending from the second member.

Statement 31. The ETJ of any of the statements 26-30, further comprising a feature to urge control lines and other equipment to enter the ETJ without causing damage to the ETJ, control lines or other equipment.

Statement 32. The ETJ of any of the statements 26-31, wherein the ETJ comprises at least one solid or fluted component made of brass, steel, elastomer, or combinations thereof.

Statement 33. The ETJ of any of the statements 26-32, wherein the lock is releasable.

Statement 34. The ETJ of any of the statements 26-33, further comprising ports operable to flush debris.

Statement 35. The ETJ of any of the statements 26-34, further comprising a tapered profile.

Statement 36. The ETJ of any of the statements 26-35, wherein the ETJ is sealed.

Statement 37. The ETJ of any of the statements 26-36, wherein a proximal end of the ETJ is operable to shift the first member from an extended position to a retracted position, upon actuation of a lock release.

Statement 38. The ETJ of any of the statements 26-37, wherein the ETJ is operable for re-extension.

Statement 39. A system for passing a control line from a primary wellbore to a secondary wellbore, the system comprising: an extensible transition joint (ETJ) comprising: at least two members; wherein a first member is operable to retract into a second member, wherein the first and second members of the ETJ are operable to receive the control line passing through the primary and secondary wellbores; and a tool operable to engage and disengage the ETJ to position the ETJ.

Statement 40. The system of the statement 39, wherein the tool comprises a completion deflector running tool (CDRT).

Statement 41. The system of the statement 39 or the statement 40, wherein the CDRT is operable to extend the ETJ.

Statement 42. The system of any of the statements 39-41, further comprising a completion string including the control line.

Statement 43. The system of any of the statements 39-42, further comprising a feature on the completion string to retract the ETJ into the secondary wellbore.

Statement 44. The system of any of the statements 39-43, wherein the feature includes a shoulder to contact the ETJ.

Statement 45. The system of any of the statements 39-44, wherein the feature is operable to provide full-bore access to the primary wellbore.

Although the present disclosure and its advantages have been described in detail, it should be understood that various changes, substitutions and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A completion deflector running tool (CDRT) comprising:

a tool body comprising a central bore;

at least one component operable to extend and retract laterally from the tool body;

a guide extending from a distal end of the tool body, the guide operable to rotate;

a first chamber and second chamber each formed within the tool body, wherein the first chamber and the second chamber are each in fluid communication with the central bore via a port wherein the pressure in the first chamber and second chamber is based at least in part on the pressure in the central bore;

a first member with a first proximal end disposed at least partially within the first chamber and a first distal end secured to the guide; and a second member with a second proximal end disposed at least partially within the second chamber and a second distal end secured to the guide, and wherein movement of the first member and the second member is configured to rotate the guide.

2. The CDRT of claim 1, further comprising a fluid altering device disposed on the guide, and chambers operable to rotate the guide.

3. The CDRT of claim 1, wherein the first member is operable to expand to orient the guide, wherein the second member is operable to compress to orient the guide.

4. The CDRT of claim 1, wherein the at least one first component includes a first dog disposed in a first section of the tool body, and wherein the first dog includes a first fluid-actuated member.

5. The CDRT of claim 4, wherein the at least one second component includes a second dog disposed in a second section of the tool body, and wherein the second dog is smaller than the first dog.

6. The CDRT of claim 1, wherein the at least one component is configured to extend and retract laterally from the tool body to engage and disengage, respectively, a completion deflector.

7. The CDRT of claim 1, wherein the at least one component is configured to extend and retract laterally from the tool body to engage and disengage, respectively, an extensible transition joint, and wherein the extensible transition joint comprises:

a first tubular member; and a second tubular member disposed within a secondary wellbore, wherein the first tubular member is movably disposed at least partially in the second tubular member, wherein the first tubular member is configured move with respect to the second tubular member to extend into a primary wellbore, via a casing window, in response to the at least one component engaging the extensible transition joint and the tool body moving in an uphole direction.

8. The CDRT of claim 7, wherein the first tubular member is secured to the second tubular member via at least one shear screw, wherein the tool body is configured to move uphole with sufficient force to shear the at least one shear screw and extend the extensible transition joint.

9. The CDRT of claim 7, wherein the at least one component is configured to disengage the extensible transition joint in response to the first tubular member of the extensible transition joint extending into the primary wellbore, wherein the tool body is pulled out-of-hole in response to disengaging the extensible transition joint.

10. The CDRT of claim 1, wherein the first chamber and the second chamber are positioned on opposite sides of the central bore.

11. The CDRT of claim 1, wherein the first member is configured to retract with respect to the first chamber in response to pressure in the first chamber rising above a first threshold pressure, and wherein second member is configured to extend in response to pressure in the second chamber rising above the first threshold pressure, and wherein retracting the first member and extending the second member is configured to rotate the guide from a straight orientation to an angled orientation for passing into a secondary wellbore to engage an extensible transition joint.

12. The CDRT of claim 11, further comprising a first spring disposed in the first chamber and a second spring disposed in the second chamber, wherein the first spring is configured to bias the first member toward an extended position and the second spring is configured to bias the second member toward a retracted position, wherein the first threshold pressure is based at least in part on the first spring and the second spring.

13. The CDRT of claim 11, wherein the at least one component is biased to extend in a laterally outward direction, wherein increasing pressure above a second threshold pressure is configured to retract the at least one component, and wherein the second threshold pressure is less than the first threshold pressure.

14. The CDRT of claim 1, wherein the central bore extends through the guide, and wherein the guide includes a pressure drop nozzle formed along the central bore.

15. A completion deflector running tool (CDRT) comprising:

a tool body comprising a central bore;

at least one component operable to extend and retract laterally from the tool body, wherein the at least one component is configured to extend and retract laterally from the tool body to engage and disengage, respectively, an extensible transition joint, and wherein the extensible transition joint comprises:

a first tubular member; and a second tubular member disposed within a secondary wellbore, wherein the first tubular member is movably disposed at least partially in the second tubular member, wherein the first tubular member is configured move with respect to the second tubular member to extend into a primary wellbore, via a casing window, in response to the at least one component engaging the extensible transition joint and the tool body moving in an uphole direction; and a guide extending from a distal end of the tool body, the guide operable to rotate.

16. The CDRT of claim 15, wherein the first tubular member is secured to the second tubular member via at least one shear screw, wherein the tool body is configured to move uphole with sufficient force to shear the at least one shear screw and extend the extensible transition joint.

17. The CDRT of claim 15, wherein the at least one component is configured to disengage the extensible transition joint in response to the first tubular member of the extensible transition joint extending into the primary wellbore, wherein the tool body is pulled out-of-hole in response to disengaging the extensible transition joint.

18. A completion deflector running tool (CDRT) comprising:

a tool body comprising a central bore;

at least one component operable to extend and retract laterally from the tool body, wherein the at least one component is configured to extend and retract laterally from the tool body to engage and disengage, respectively, a completion deflector and an extensible transition joint, and wherein the extensible transition joint comprises:

a first tubular member; and a second tubular member disposed within a secondary wellbore, wherein the first tubular member is movably disposed at least partially in the second tubular member, wherein the first tubular member is configured move with respect to the second tubular member to extend into a primary wellbore, via a casing window, in response to the at least one component engaging the extensible transition joint and the tool body moving in an uphole direction; and a guide extending from a distal end of the tool body, the guide operable to rotate.

19. The CDRT of claim 18, wherein the first tubular member is secured to the second tubular member via at least one shear screw, wherein the tool body is configured to move uphole with sufficient force to shear the at least one shear screw and extend the extensible transition joint.

20. The CDRT of claim 18, wherein the at least one component is configured to disengage the extensible transition joint in response to the first tubular member of the extensible transition joint extending into the primary wellbore, wherein the tool body is pulled out-of-hole in response to disengaging the extensible transition joint.

* * * * *